US007400304B2

(12) United States Patent
Lewis et al.

(10) Patent No.: US 7,400,304 B2
(45) Date of Patent: Jul. 15, 2008

(54) ANTENNA WITH PARTIALLY SPHERICAL DIELECTRIC LENSES

(75) Inventors: Robert Alan Lewis, Maldon (GB); Christian Rieckmann, Niedersachsen (DE); James Christopher Gordon Matthews, Colchester (GB); Peter Edge, South Benfleet (GB)

(73) Assignee: BAE Systems plc, London (GB)

( * ) Notice: Subject to any disclaimer, the term of this patent is extended or adjusted under 35 U.S.C. 154(b) by 0 days.

(21) Appl. No.: 10/594,085

(22) PCT Filed: Mar. 29, 2005

(86) PCT No.: PCT/GB2005/001224

§ 371 (c)(1),
(2), (4) Date: Sep. 25, 2006

(87) PCT Pub. No.: WO2005/093905

PCT Pub. Date: Oct. 6, 2005

(65) Prior Publication Data

US 2007/0216596 A1 Sep. 20, 2007

(30) Foreign Application Priority Data

Mar. 26, 2004 (GB) ..... 0406814.4

(51) Int. Cl.
*H01Q 15/02* (2006.01)
*H01Q 19/06* (2006.01)

(52) U.S. Cl. ..... 343/753; 343/909; 343/911 L
(58) Field of Classification Search ..... 343/753, 343/909, 910, 911 L, 911 R, 756, 848

See application file for complete search history.

(56) References Cited

U.S. PATENT DOCUMENTS

| | | | | |
|---|---|---|---|---|
| 3,386,099 | A | 5/1968 | Walter et al. | |
| 5,781,163 | A | 7/1998 | Ricardi et al. | |
| 6,424,319 | B2 * | 7/2002 | Ebling et al. | 343/911 L |
| 7,042,420 | B2 * | 5/2006 | Ebling et al. | 343/911 L |
| 7,061,448 | B2 * | 6/2006 | Kuroda et al. | 343/911 L |
| 7,221,328 | B2 * | 5/2007 | Kuroda et al. | 343/911 L |
| 2003/0006941 | A1 | 1/2003 | Ebling et al. | |
| 2006/0145940 | A1 * | 7/2006 | Kuroda et al. | 343/911 R |

FOREIGN PATENT DOCUMENTS

| | | |
|---|---|---|
| JP | 10-163730 | 6/1998 |
| WO | 01/37374 A1 | 5/2001 |
| WO | 2004/010534 A1 | 1/2004 |

* cited by examiner

*Primary Examiner*—Tan Ho
(74) *Attorney, Agent, or Firm*—Buchanan Ingersoll & Rooney PC

(57) ABSTRACT

An antenna is provided comprising a first group of part-spherical dielectric lenses supported on a first portion of a conducting ground place arranged to reflect signals emerging from the lens, each of the lenses having a number of associated switchably selectable antenna feed elements arranged around the periphery of at least one sector of the lens for injecting signals into and/or receiving signals propagated by the lens, wherein each lens and the associated feed elements of the first group has a different orientation and may be operated to provide coverage in respect of a different region. The antenna also comprises a second group of one or more spherical or part-spherical dielectric lenses and associated switchably selectable antenna feed elements, oriented and operable to provide coverage to a region other than that covered by lenses of the first group. The first portion of the ground plane may be substantially annular and arranged to surround a well-like region of the antenna in which the second group of one or more lenses may be accommodated.

13 Claims, 7 Drawing Sheets

ANTENNA WITH PARTIALLY SPHERICAL DIELECTRIC LENSES

FIELD

The present invention relates to an antenna and in particular to a multiple beam antenna. More particularly, but not exclusively, the invention relates to a low-profile multiple beam antenna operable to provide at least hemispherical coverage.

BACKGROUND

Lens-based multiple beam antennae are known to offer a viable and lower cost alternative to phased array antennae for use in a range of applications, both military and non-military. In particular, multiple beam antennae with electronically switched beams and spherical dielectric lenses are known which are able to produce a wide field of coverage while avoiding some of the engineering issues that can arise with phased array antennae.

In US 2003/0006941, a multiple beam antenna comprises a hemispherical dielectric lens with multiple associated switchably selectable antenna feed elements, the lens being mounted adjacent to a reflector and being operable to provide directional coverage.

Multiple beam antennae may use spherical or partially spherical dielectric lenses, e.g. hemispherical lenses, in particular lenses known as "Luneburg" lenses having a continuously varying or step-graded index profile. In a known arrangement, a so-called "virtual source" antenna comprises a half (hemispherical) Luneburg lenses mounted adjacent to a conducting ground plane. When signals are injected into the lens at a certain angle by one of a number of switchable radiating elements disposed around a portion of the lens, radiation emerges from the lens, is reflected off the ground plane, and re-enters the lens at a different angle, so simulating the effect of a virtual source of radiation as if a full spherical Luneburg lens were being used.

Several methods of fabricating Luneburg lenses, capable of operating at microwave frequencies, have been developed. The most common method uses a hemispherical shell construction yielding an approximate stepped or graded index profile.

U.S. Pat. No. 5,781,163 describes an antenna arrangement based upon hemispherical dielectric lenses arranged as a collinear array of half Luneburg lenses mounted on a common ground plane, providing a low profile, low radar cross section, high-gain antenna. Each hemispherical lens is fed by a single radiating feed element mounted on a feed arm. Beam pointing is achieved by rotating the ground plane and moving all radiating feed elements simultaneously along their feed arms.

In one particular type of large array of full or half Luneburg lenses, it has been proposed to build a radiometer with exceptionally high gain. The antenna in that case was designed to operate at low microwave frequencies, typically less than around 5 GHz. Although low radar cross section is not an issue at these frequencies, half Luneburg lenses may be preferred because the ground plane offers a way of mechanically supporting the weight of the lenses. Each lens may be fed by a single radiating element or clusters of elements that are mounted on feed arms and are mechanically steered.

In known arrangements above, in order to provide at least hemispherical coverage, a certain amount of mechanical steering is required to the antenna.

SUMMARY

From a first aspect, the present invention resides in an antenna, comprising a first group of part-spherical dielectric lenses each supported on a first, substantially annular portion of a conducting ground plane surrounding a well-like portion of the antenna, each of the lenses of the first group having a plurality of associated switchably selectable antenna feed elements disposed around the periphery of the lens for injecting signals into and/or receiving signals emerging from at least one sector of the lens, wherein lenses of the first group and their associated feed elements have different orientations and are operable to provide coverage in respect of different regions, and a second group of one or more spherical or part-spherical dielectric lenses and associated switchably selectable antenna feed elements located within said well-like portion of the antenna, oriented and operable to provide coverage to a region other than those covered by lenses of the first group.

Utilising the spherical symmetry of the lens, a relatively wide field of view may be provided by each lens, ideally without blockage between the switchably selectable antenna feed elements. Moreover, deployment of one or more lenses in the well-like region of the antenna enables a greater angle of coverage to be provided without increasing the overall height of the antenna arrangement above a mounting surface. The conducting ground plane may further comprise a second portion inclined differently to the first portion, and the second group of one or more lenses comprises at least one part-spherical lens supported by the second portion of the ground plane, for example where the second portion of the ground plane forms the side-walls of the well-like portion of the antenna.

In an alternative arrangement, rather than mounting part-spherical lenses on ground plane walls of the well-like portion, a single spherical lens may be located within the well-like portion of the antenna to provide equivalent coverage to an arrangement of part-spherical lenses mounted within the well.

Preferably, the first portion of the ground plane surrounds a substantially square well-like portion and the first group of one or more lenses comprises four part-spherical lenses disposed with substantially equal spacing around the well-like portion. Where the second portion of the ground plane forms the side-walls of a square well-like portion of the antenna, preferably inclined at approximately 45 degrees to the corresponding sections of the first portion of the ground plane, one part-spherical lens may be mounted on each of the four walls of the well.

In a further preferred embodiment of the present invention, the conducting ground plane further comprises a third portion inclined differently to the first and second portions and the antenna further comprises a third group of one or more part-spherical dielectric lenses, each having a plurality of associated switchably selectable antenna feed elements, supported by the third portion of the conducting ground plane and operable to provide coverage to a different region to those covered by the first and second groups of lenses.

Preferably antenna feed elements are located on the surface of each lens or at a convenient distance away from the lens surface, preferably on the focal surface of the lens. Antenna feed elements of preferred antennae may either transmit a beam into any desired direction (transmit mode) or receive a signal from any desired direction (receive mode) from within the solid angle of view of the antenna, preferably at least hemispherical.

Conveniently antennae are mounted on flat surfaces. By arranging hemispherical lenses or combinations of hemispherical and spherical lenses in this manner, the antenna extends only half as far above a surface as was previously the case compared with conventional antennae employing full spherical lenses or reflectors.

In a particularly preferred embodiment an entire antenna system according to preferred embodiments of the present invention may be mounted behind a frequency selective surface (FSS) that is transparent to frequencies used by the lens, but absorbent or reflective to other frequencies. This offers a great advantage in terms of radar cross section. The reduced physical height of a half Luneburg lens allows a more compact antenna installation on a vehicle which simplifies the design of a combined radome/FSS. This simplification and the simplification at the junction of the FSS and airframe reduces the radar cross-section. If suitably dimensioned and arranged, the profile of such a frequency selective screen may also help reduce aerodynamic drag, for example when the antenna is mounted upon the fuselage of a craft, aircraft or vessel.

Using a plurality of lenses, each having a number of antenna feed elements, it is possible to arrange the feed elements such that they do not block one another.

Using several electronically switched beams, rather than a single mechanically steered beam per lens; a high switching speed can be realised. By utilising high-speed microwave switches, such as PIN diode switches, the operating speed of a preferred switching network for that switching a signal to an individual antenna feed element on a particular lens or part of a lens, is greatly enhanced. A high switching speed is vital for a number of applications such as electronic support measures (ESM) systems.

For the avoidance of doubt, it is pointed out that the antenna itself, is not an array antenna, although a plurality of lenses and feed elements are employed. This is because the antenna may be operated if required with only a single beam switched on at any one time. However, if multiple transmit/receivers are connected to the multiple feeds, a number of independent radiation pattern beams can be formed simultaneously. This allows the antenna to act as a node in a multi-point communication network for example.

DESCRIPTION OF THE DRAWINGS

Preferred embodiments of the present invention will now be described in more detail by way of example only, and with reference to the accompanying drawings of which.

DETAILED DESCRIPTION

Known features used within preferred embodiments of the present invention will be described firstly by way of background information with reference to FIGS. 1 to 4.

Figure 1:
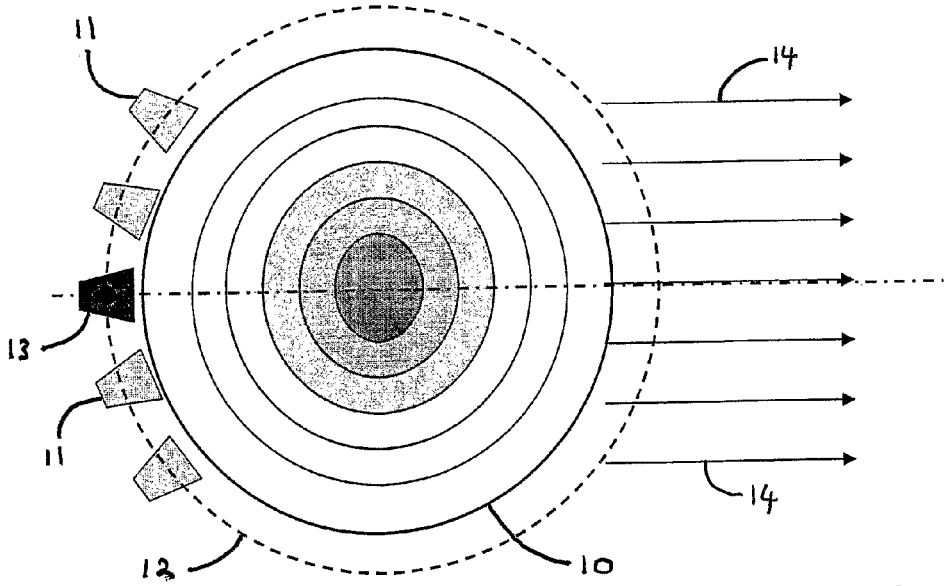
FIG. 1 is a diagrammatical cross section of an example of a Luneburg lens, operated as part of a receiving multiple beam antenna, and shows regions of varying refractive index.

Referring firstly to FIG. 1, a basic multiple beam antenna is shown based upon a Luneburg lens 10. In the example of FIG. 1, a Luneburg lens 10 is shown having a stepped index profile to approximate an ideal continuously varying index profile, each step being provided by a different concentrically arranged layer of dielectric material of a different relative permittivity ($\epsilon$). That portion at the centre of the lens has the maximum value with successive layers having monotonically decreasing values. The antenna further comprises a number of switchably selectable antenna feed elements 11, 13 located at points preferably around the focal surface 12 of the lens 10 (where that focal surface 12 does not coincide with the actual surface of the lens 10) that may be linked to one or more transmitters or receivers by means of transmission lines (not shown). One antenna feed element 13, in particular, when energised, would typically cause a substantially parallel beam of radiation 14 to be emitted from the lens 10, as shown in FIG. 1. Similarly, energising other ones of the antenna feed elements 11 would cause radiation to be emitted from the lens 10 in other directions, hence providing coverage in various directions as required. Furthermore, radiation incident to the antenna would be focussed by the lens 10 onto one or other of the antenna feed elements 11, 13 enabling signals to be received upon selecting the appropriate feed element.

Although a stepped dielectric lens may be preferred to approximate the continuously varying dielectric properties of an ideal Luneburg lens 10, it will be clear that other types of spherical and part-spherical lenses, such as "constant k" lenses or "two-shell" lenses, may be used in preferred embodiments of the present invention to focus radiation from a point source into a beam and vice versa.

Figure 2:
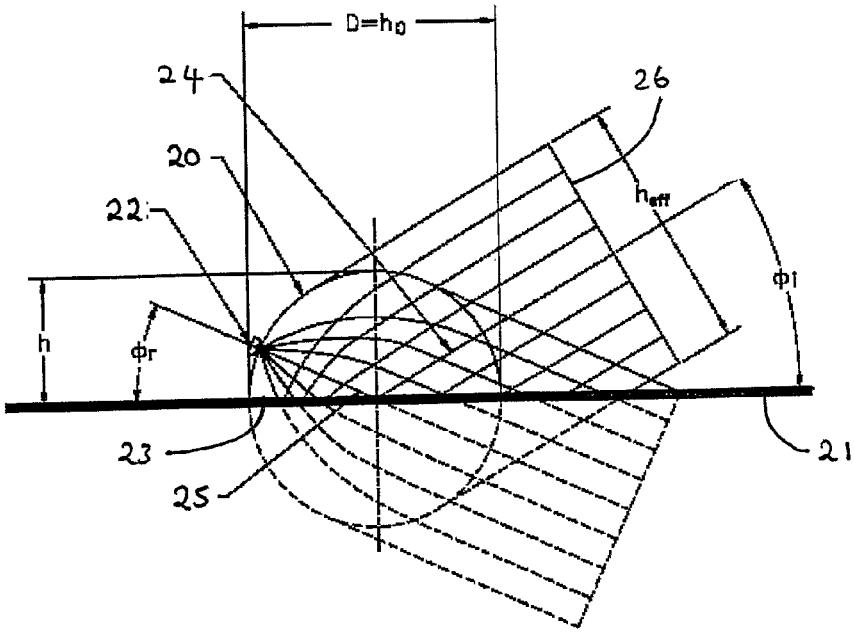
FIG. 2 illustrates array geometry for a hemispherical (virtual source) Luneburg lens antenna.

Referring to FIG. 2, an antenna arrangement known as a "virtual source antenna" is shown in which a half-Luneburg or hemispherical Luneburg lens 20 is supported on a conducting ground plane 21. One or more antenna feed elements 22 are provided to inject signals into the lens 20 or to receive signals propagated by the lens 20. As illustrated in FIG. 2, radiation emerging from the lower flat surface 23 of the lens 20 is paths 12 are reflected from the ground plane 21 in accordance with Snell's law. Snell's law states that the angle of incidence is equal to the angle of reflection. For example, as illustrated in FIG. 2, an incident ray 24 entering the lens 20 at an angle $\phi_i$ to the ground plane 21 and directed towards the centre of the lens 20, is reflected by the ground plane 21 in a ray 25 that re-enters the lens 20 at angle $\phi_r$ (equal to $\phi_i$) for propagation to the antenna feed 22. As can be seen in FIG. 2, the presence of the ground plane simulates the use of a full spherical lens in that, from the perspective of the antenna feed element 22, an incident wavefront 26 appears to be coming from the other side of the ground plane 21 as illustrated by dashed lines in FIG. 2.

For classical planar arrays, or reflector antennae, the effective vertical dimension of the antenna aperture $h_{eff}$ must be less than h, the maximum allowable protrusion of the antenna lens 20 above the ground plane 21. The same applies for antenna installations based on full Luneburg lenses. By comparison, the effective vertical dimension of a hemispherical Luneburg lens antenna aperture $h_{eff}$ can be twice as large as the physical height h. The inherently larger aperture of a hemispherical Luneburg lens 20 results in an antenna gain of twice that of a conventional antenna, with the same aperture height h protruding above the ground plane 21. For airborne platforms this means that aerodynamic drag and radar cross section contribution can be reduced, as compared with a conventional reflector or array antenna of the same effective size. As will be described below in a preferred embodiment of the present invention, if the antenna is enclosed by a frequency selective radome, radar cross section can be reduced for frequencies outside the operation band.

Figure 3:
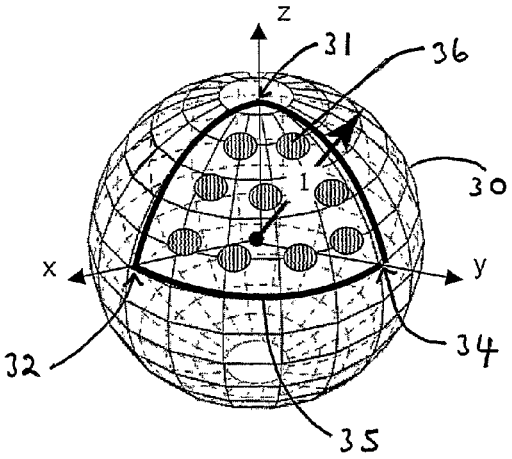
FIG. 3 illustrates a technique for placing antenna feed elements on the surface of a spherical dielectric lens in order to avoid blockage of signals by such feed elements.

In preferred embodiments of the present invention, electronically switched beams are used to achieve substantially hemispherical coverage. This is achieved by controlling and manipulating beams, without individual antenna feed elements 11, 13, 22 blocking one other. FIG. 3 illustrates a technique for arranging antenna feed elements so that blockage is avoided.

Referring to FIG. 3, if an antenna feed element is located at the "North Pole" (0,0,1) 31 of a Luneburg lens 30 of unit radius, then blockage is avoided provided that no antenna feed element is located on the Southern Hemisphere, (assuming that the full Luneburg lens aperture is utilised). Similarly, if an antenna feed element is located on the equator, e.g. at (1,0,0) 32, then no blockage occurs provided that there is no antenna feed element on the hemisphere described by $x<0$. Finally, if an antenna feed element is located on the equator at (0,1,0) 34, no blockage occurs if there is no antenna feed element on the hemisphere described by $y<0$. The boundaries imposed by the no-blockage condition for the three discussed points 31, 32, 34 define an octant 35 of a unit sphere, as depicted in FIG. 3. If active antenna feed elements 36 are placed within this octant 35 only, then no blockage occurs. Full hemispherical coverage may therefore be achieved with an antenna comprising four full Luneburg lenses each having one octant, as shown in FIG. 3, populated by antenna feeds elements 36. FIG. 4 illustrates such a configuration of Luneburg lenses.

Figure 4A:
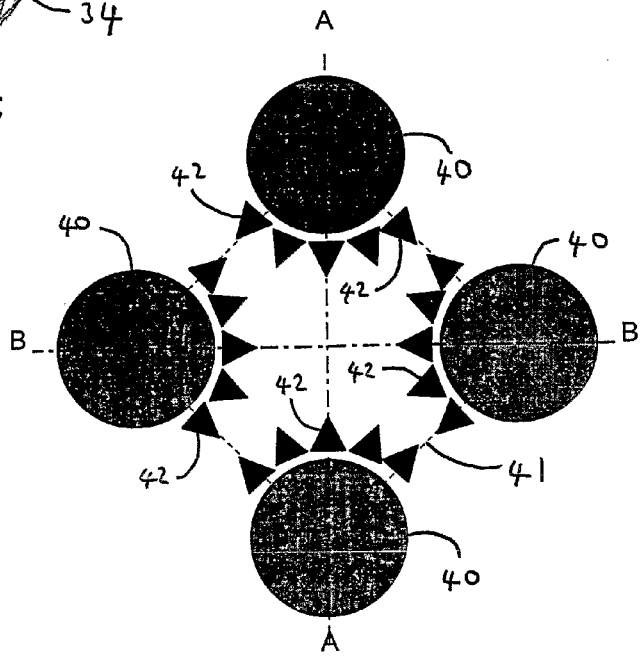
FIGS. 4*a* and 4*b* show an example of an antenna arrangement comprising four full Luneburg lenses and associated feed elements designed to provide hemispherical coverage without blockage.
Figure 4B:
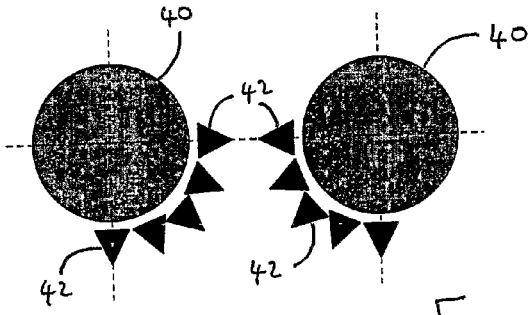

Referring to FIG. 4*a*, four full Luneburg lenses 40 are provided having their centres arranged in a square formation 41. Antenna feed elements 42 are located within this square area. Each Luneburg lens 40 and its associated antenna feed elements 42 contributes one quadrant of a full hemispherical view. The antenna installation of FIG. 4*a* enables the full upper hemisphere to be covered by beams. FIG. 4*b* illustrates a plane section A-A through the antenna arrangement of FIG. 4*a* viewed along the line B-B.

Antenna installations on air, sea and land platforms are often required to be flush mounted to a mounting surface due to drag, Radar Cross Section (RCS) and aesthetics. If the antenna is attached to the surface of an aircraft, for example, the profile must be sufficiently small to prevent intolerable drag and air stream turbulence. In practice, an antenna is usually covered by a radome for environmental protection. A low-profile requirement forces medium and high gain antennae (>20 dBi) to have an approximately rectangular or elliptical radiating aperture with a width to height ratio greater than four. The Luneburg lens configuration shown in FIG. 4 is non-ideal in terms of radar cross section, as the height of the antenna installation, above a supporting structure (not shown), is at least the full diameter D of a Luneburg lens 40.

Preferred embodiments of the present invention will now be described with reference to the remaining FIGS. 5 to 8.

Figure 5A:
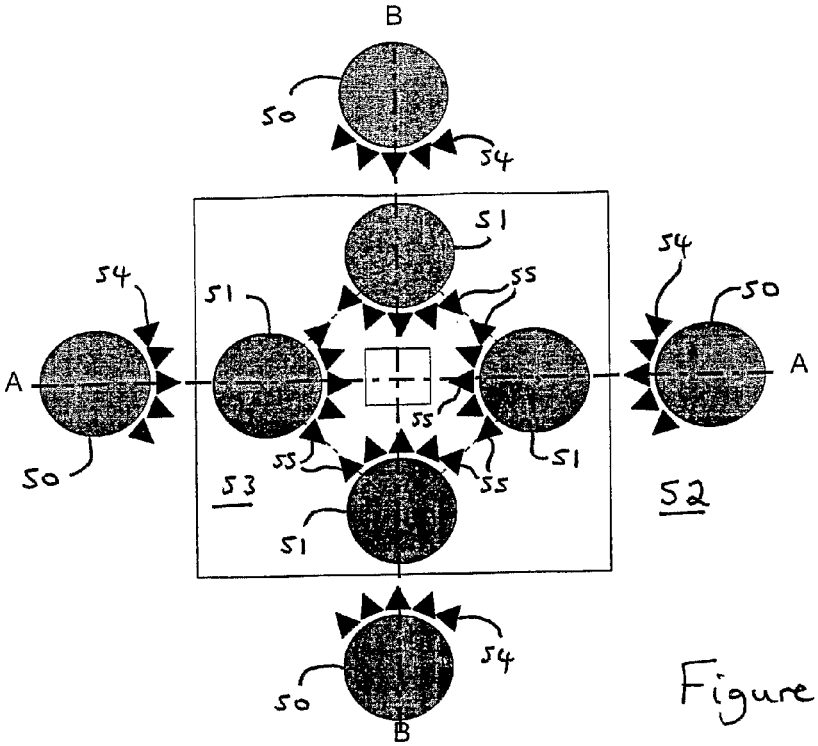
FIGS. 5*a*-5*d* show a multiple beam antenna arrangement according to a preferred embodiment of the present invention, based upon virtual source antennae preferably of the type shown in FIG. 2, and designed to provide at least full hemispherical coverage without blockage.
Figure 5B:
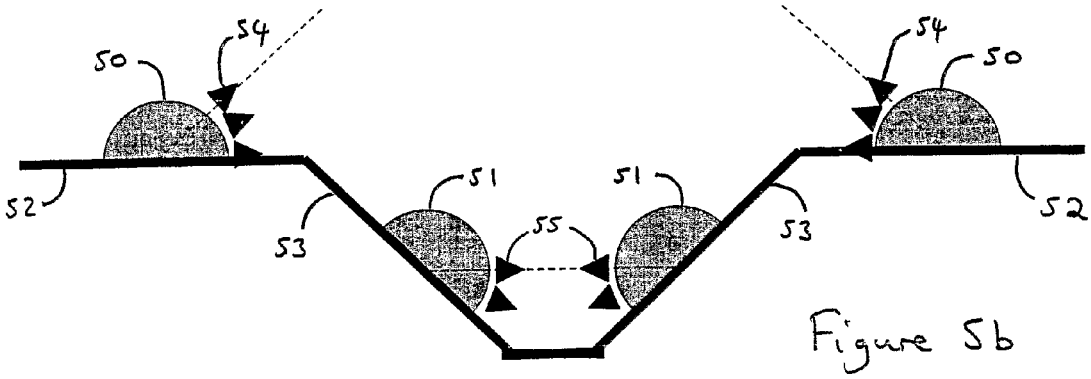

Referring firstly to FIG. 5*a*, a preferred antenna arrangement is shown in plan view based upon virtual source antennae of a type described above with reference to FIG. 2, used to provide a multi-beam antenna with hemispherical coverage while avoiding blockage by antenna feed elements. FIG. 5*b* provides a section view of the arrangement of FIG. 5*a* through the plane A-A, as viewed in the direction B-B. In the arrangement of FIG. 5, the antenna comprises eight hemispherical Luneburg lenses 50, 51. The outer four hemispherical Luneburg lenses 50 are mounted on a horizontal ground plane 52, whereas the inner four hemispherical Luneburg lenses 51 are mounted on a well-like section of ground plane 53 that is inclined at an angle of approximately 45° with respect to the horizontal section of ground plane 52. Each of the outer hemispherical Luneburg lenses 50 is populated by associated antenna feed elements 54, arranged on a rectangular sector measuring approximately 90° in azimuth (as seen in FIG. 5*a*) and approximately 45° in elevation (as seen in FIG. 5*b*). For the inner hemispherical Luneburg lenses 51, associated antenna feed elements 55 lie on a substantially triangular sector (shown in FIG. 5*b*), measuring 90° in azimuth and 45° in elevation.

Compared with the multiple beam antenna installation shown in FIG. 4, the height of the preferred antenna arrangement shown in FIG. 5 extending above the mounting surface is reduced to half its value. This means that aerodynamic drag of the preferred antenna arrangement installation 40 shown of FIG. 5 is greatly improved compared with the installation shown in FIG. 4.

Figure 5C:
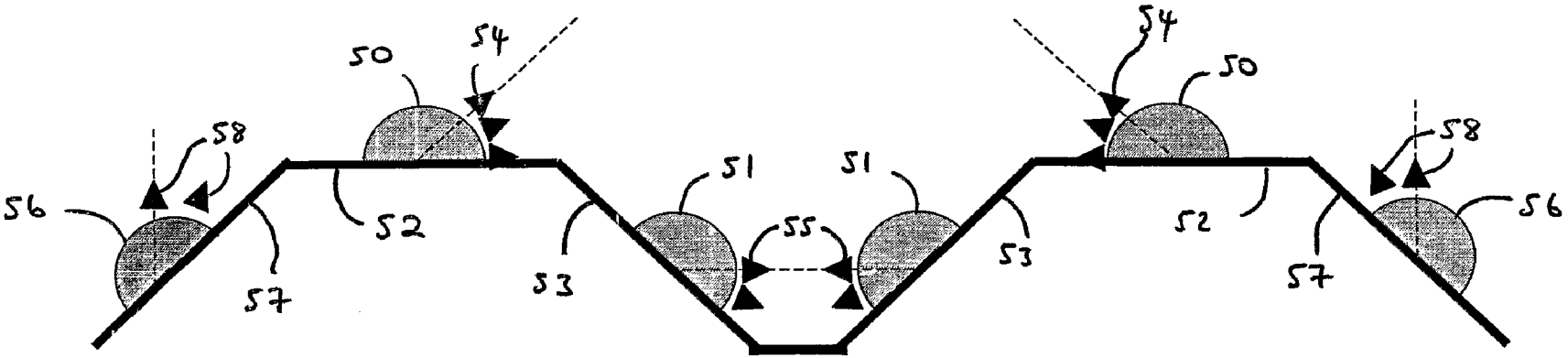
Figure 5D:
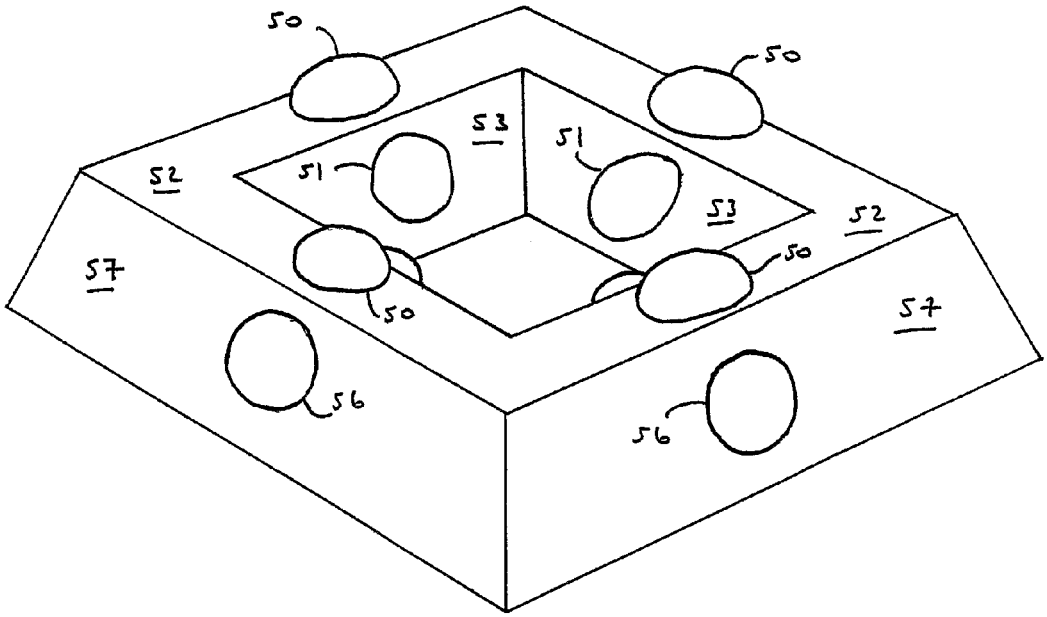

Referring to FIGS. 5*c* and 5*d*, an improved antenna arrangement is provided in which additional lenses 56 and associated antenna feed elements 58 are supported on a ring-sectioned ground plane 57 disposed around the outside of the group of lenses 50 and inclined at approximately 45° to the adjacent sections of the horizontal ground plane 52 and therefore at approximately 90° to the corresponding inner sections of the ground plane 53. An advantage of this preferred arrangement is that the field of view is extended beyond a hemispherical view.

A further preferred embodiment of the present invention will now be described with reference to FIG. 6.

Figure 6A:
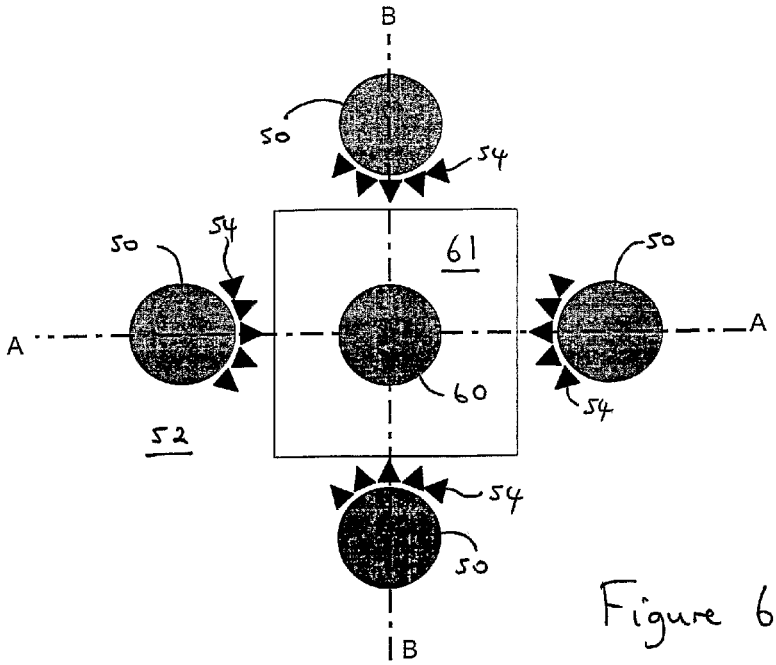
FIGS. 6*a* and 6*b* show a multiple beam antenna arrangement according to a further preferred embodiment of the present invention, using a combination of virtual source antennae and a full Luneburg lens to provide full hemispherical coverage without blockage.
Figure 6B:
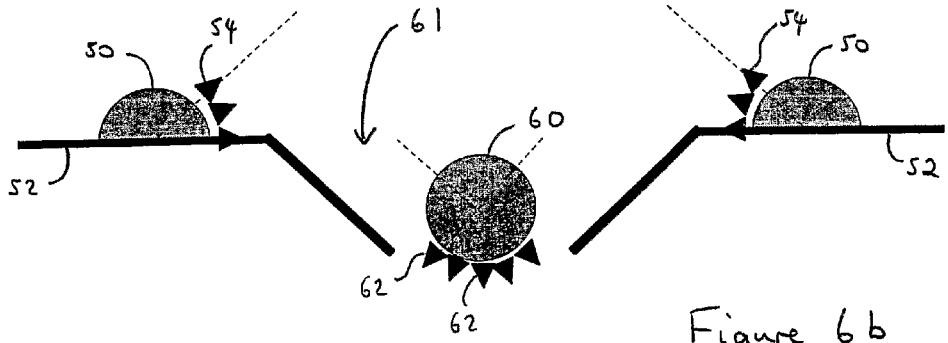

Referring to FIG. 6, rather than use four inner hemispherical Luneburg lenses, such as the inner lenses 51 shown in FIG. 5 supported in a well-like portion of ground plane 53 with their associated triangular sectors of antenna feed elements 55, an alternative embodiment of the antenna in FIG. 5 is achieved, without causing blockage, by deploying a single spherical Luneburg lens 60, with an associated octant arrangement of antenna feed elements 62, within a well-like region in FIG. 6*b* in section through the plane A-A as viewed in the direction B-B. In the preferred embodiment of FIG. 6, fewer Luneburg lenses are required than in the arrangement of FIGS. 5*a* and 5*b* while offering the same advantages of low profile and a low radar cross section.

In the preferred antenna arrangements of the present invention, antenna feed elements 54, 55, 58, 62 are switchably selectable to provide beam coverage in different directions. A preferred switching technique will now be described with reference to FIG. 7.

Figure 7:
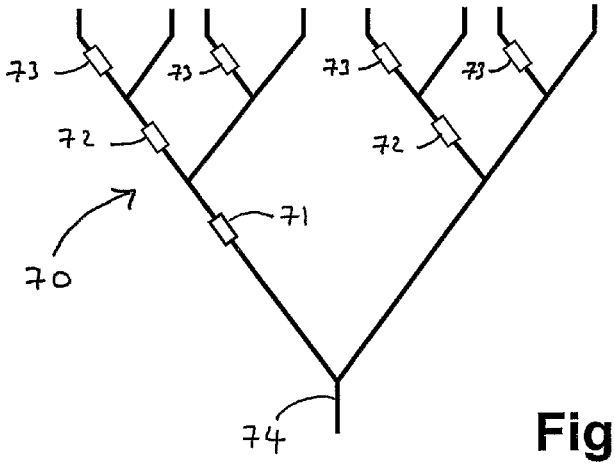
FIG. 7 shows a diagrammatical representation of a binary tree switching network of a type suitable for use in selecting and providing an RF signal path to antenna feed elements in antenna arrangements according to preferred embodiments of the present invention.

Referring to FIG. 7, a typical switching network 70 is shown comprising a plurality of switches 71, 72, 73 arranged in a binary tree. A top layer of switches 73 is connected to antenna feed elements 54, 55, 58, 62. As is typical in a binary tree arrangement, each layer of switches 72, 73 is fed by a layer below having at most half as many switches. An input/output 74 to the lowest layer of the network 70 is connected to a transmitter (not shown) or receiver (not shown), respectively. The number of switches 71, 72, 73 required for a binary switching network 70 feeding N antenna feed elements 54, 55, 58, 62 is:

$$1+2+4+\ldots+N/2=N-1$$

The complexity of the switching network 70 is determined by the required gain of the multiple beam antenna. Because a high gain translates into a large number of antenna feed elements 54, 55, 58, 62, which itself translates into a large number of switches 71, 72, 73, the higher the gain, the greater is the requirement for switches. Each switch 71, 72, 73 requires a radio frequency (RF) path and a logic circuit (not shown in FIG. 7). An RF path may be selected from a particular antenna feed element 54, 55, 58, 62 to a transmitter/receiver via the input/output 74 of the network 70 by means of a suitable combination of bias voltages applied to switch logic circuits, as is well known in the art.

If multi-throw switches (not shown) rather than double-throw switches 71, 72, 73 are used to form a switching network suitable for use in preferred embodiments of the present invention, then the corresponding switching network tree is not a binary tree and fewer switches and switching layers may be required to achieve a required degree of antenna feed element selection.

A further preferred embodiment of the present invention will now be described with reference to FIG. 8.

Figure 8:
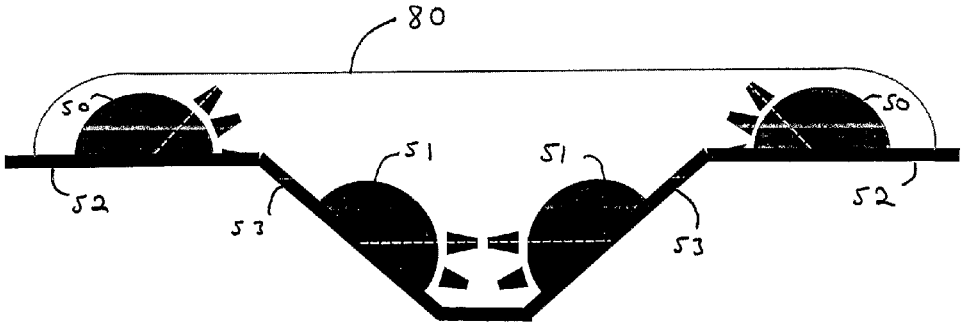
FIG. 8 shows a diagrammatical view of an alternative embodiment of the present invention showing a multiple beam antenna assembly according to preferred embodiments of the present invention enclosed behind a frequency selective surface.

Referring to FIG. 8, an antenna arrangement according to any one of the preferred embodiments of the present invention described above, although in this example that described above with reference to FIGS. 5*a* and 5*b*, may be enclosed by a frequency-selective surface 80, operable to permit signals used by the antenna to pass through the surface 80 and to either reflect or absorb other signals. The surface 80 may serve additionally as a protective and aerodynamically low-drag radome for preferred embodiments of the antenna.

It will be appreciated that the invention described herein has a number of possible applications, for example on different types of platforms (ship, aircraft and land vehicle). A low profile, for example to reduce aerodynamic drag, is a crucial requirement for many of these systems and the invention offers this as well as other advantages over existing wide-angle scanning antennae.

It will be appreciated that variation may be made to the embodiments of the invention described herein without departing form the scope of the invention.

The invention claimed is:

1. An antenna, comprising a first group of part-spherical dielectric lenses each supported on a first, substantially annular portion of a conducting ground plane surrounding a well-like portion of the antenna, each of the lenses of the first group having a plurality of associated switchably selectable antenna feed elements disposed around the periphery of the lens for injecting signals into and/or receiving signals emerging from at least one sector of the lens, wherein lenses of the first group and their associated feed elements have different orientations and are operable to provide coverage in respect of different regions, and a second group of one or more spherical or part-spherical dielectric lenses and associated switchably selectable antenna feed elements located within said well-like portion of the antenna, oriented and operable to provide coverage to a region other than those covered by lenses of the first group.

2. An antenna according to claim 1, wherein the second group of one or more lenses comprises a spherical lens, located within said well-like portion of the antenna.

3. An antenna according to claim 1, wherein the conducting ground plane further comprises a second portion inclined differently to the first portion, and wherein the second group of one or more lenses comprises at least one part-spherical lens supported by the second portion of the ground plane.

4. An antenna according to claim 3, wherein the second portion of the ground plane is arranged to form, the side-walls of said well-like portion.

5. An antenna according to claim 3, wherein the conducting ground plane further comprises a third portion inclined differently to the first and second portions and wherein the antenna further comprises a third group of one or more part-spherical dielectric lenses, each having a plurality of associated switchably selectable antenna feed elements, supported by the third portion of the conducting ground plane and operable to provide coverage to a different region to those covered by the first and second groups of lenses.

6. An antenna according to claim 1, wherein the first portion of the ground plane surrounds a substantially square well-like portion and wherein the first group of one or more lenses comprises four part-spherical lenses disposed with substantially equal spacing around the well-like portion.

7. An antenna according to claim 6, wherein the second group of one or more lenses comprises four part-spherical lenses each one supported on a different side-wall of the well-like portion.

8. An antenna according claim 1, wherein each of said antenna feed elements is located at a point on the focal surface of the respective dielectric lens.

9. An antenna according to claim 1, further comprising a switching network operable to select one or more of the antenna feed elements associated with said groups of lenses.

10. An antenna according to claim 9, wherein said switching network is a binary switching array.

11. An antenna according to claim 1, further comprising a frequency-selective surface arranged to provide an enclosure for said lenses of the antenna and operable to permit passage of signals used by the antenna but to absorb or reflect other signals.

12. An antenna according to claim 11, wherein said frequency-selective surface is arranged to have an aerodynamically low-drag profile.

13. An antenna according to claim 1, operable to provide simultaneously a plurality of independent radiation beams in different directions.

* * * * *